US006263965B1

(12) United States Patent
Schmidt et al.

(10) Patent No.: US 6,263,965 B1
(45) Date of Patent: Jul. 24, 2001

(54) MULTIPLE DRAIN METHOD FOR RECOVERING OIL FROM TAR SAND

(75) Inventors: Brian H. Schmidt, Okotoks; Paul J. Jespersen, Calgary; Brian J. Kristoff, Regina, all of (CA)

(73) Assignee: Tecmark International, Saskatoon (CA)

( * ) Notice: Subject to any disclaimer, the term of this patent is extended or adjusted under 35 U.S.C. 154(b) by 0 days.

(21) Appl. No.: 09/289,971

(22) Filed: Apr. 13, 1999

Related U.S. Application Data

(60) Provisional application No. 60/086,890, filed on May 27, 1998.

(51) Int. Cl.[7] ..... E21B 43/24

(52) U.S. Cl. ..... 166/272.3; 166/303; 166/369

(58) Field of Search ..... 166/252.5, 272.3, 166/272.7, 279, 303, 369, 245

(56) References Cited

U.S. PATENT DOCUMENTS

| | | | | |
|---|---|---|---|---|
| 3,386,508 | | 6/1968 | Beilstein et al. . | |
| 4,160,481 | | 7/1979 | Turk et al. . | |
| 4,344,485 | | 8/1982 | Butler . | |
| 4,390,067 | * | 6/1983 | Willman | 166/245 |
| 4,456,065 | | 6/1984 | Heim et al. . | |
| 4,460,044 | * | 7/1984 | Porter | 165/252 |
| 4,463,988 | | 8/1984 | Bouck et al. . | |
| 4,685,515 | | 8/1987 | Huang et al. . | |
| 4,696,345 | * | 9/1987 | Hsueh | 166/245 |
| 5,016,710 | | 5/1991 | Renard et al. . | |
| 5,402,851 | | 4/1995 | Baiton . | |
| 5,450,902 | | 9/1995 | Matthews . | |

* cited by examiner

*Primary Examiner*—William Neuder
*Assistant Examiner*—Zakiya Walker

(57) ABSTRACT

A thermal method is described for recovering normally immobile hydrocarbon oil from a subsurface tar sand deposit. The procedure comprises: (a) establishing at least one substantially vertical production bore hole extending from the surface of the earth to at least the bottom of said subsurface formation; (b) providing a plurality of bore holes extending downwardly from the surface of the earth through the tar sand formation to substantially the bottom thereof and then substantially horizontally at or near the bottom of the tar sand formation and converging radially inward to each bore hole, each radial bore hole containing a perforated or slotted tube; (c) continuously injecting steam downwardly through the perforated or slotted tubes whereby the steam discharges through the perforations or slots and into the tar sand formation to reduce the viscosity of the normally immobile oil, with a substantial proportion of the steam being injected into the formation via the portion of each tube extending downwardly through the tar sand formation whereby the steam reduces the viscosity of the normally immobile oil over an area extending substantially between the perforated tube and the top of the tar sand formation with this viscosity reducing area expanding radially and moving axially inwardly toward the vertical production bore hole thereby creating an expanding generally conical-shaped production chamber; and (d) draining the less viscous oil and steam condensate thus obtained downwardly by gravity to the bottom of the production chamber and then through the horizontal tubes into the bottom of the vertical production bore hole for collection.

10 Claims, 8 Drawing Sheets

MULTIPLE DRAIN METHOD FOR RECOVERING OIL FROM TAR SAND

CROSS REFERENCE TO RELATED APPLICATION

This application claims benefits of Applicants' U.S. Provisional Patent Application No. 60/086,890, filed May. 27, 1998 now abandoned.

BACKGROUND OF THE INVENTION

This invention relates to in situ recovery of oil from tar sand located in a subsurface formation. More particularly, the invention provides a method for recovering oil from a subsurface tar sand formation by means of a unique steam injection system.

There are many methods for recovering a resource, such as tar sand, from beneath the earth surface. Where there is little overburden, surface mining techniques have been widely employed. However, when the overburden is thick or the ratio of overburden to tar sand formation thickness is high, then surface mining is no longer economical. Many in situ recovery methods have been proposed over the years. Typically, wells are drilled from the earth surface down into the tar sand formation. These tar sand formations in their normal or undisturbed state are very viscous and immobile. Many different techniques have been developed to establish both a communication path through the heavy, highly viscous bitumen-filled sand and an efficient method to recovery the bitumen from the sand. These methods include such things as steam injection, solvent flooding, gas injection, etc. Such processes generally involve the heating of the tar sand formation to reduce the viscosity of the formation, thereby allowing removal of the resource from the formation in flowable form by hydraulic means or gravity flow.

U.S. Pat. No. 4,160,481 uses a plurality of bore holes radially extending from a central bore hole to inject steam into the tar sand formation. Steam is injected into some bore holes to drive the oil into the remaining bore hole where it is collected.

In Turk et al., U.S. Pat. No. 4,160,481, a method is described in which perforated radial tubes extend laterally into the formation from a central bore hole. That system uses a cyclic steam injection procedure. After a number of steam injection/production cycles, the process can be converted to a continuous steam drive where steam is continuously injected into one radial and oil is produced from another radial.

Bouck et al., U.S. Pat. No. 4,463,988, describes an in situ recovery system for a tar sand deposit in which a network of horizontal production tunnels and connecting horizontal bore holes are provided. This is a complex structure and a difficult and expensive one to install and operate.

Bielstein et al., U.S. Pat. No. 3,386,508, describes a system for recovering oil in which a plurality of directional (slant) wells are drilled from the surface to intersect a central vertical well within an oil bearing formation. Both the directional wells and the vertical well bore communicate fluidly with the oil bearing formation.

In Renard et al., U.S. Pat. No. 5,016,710, another system for recovering oil is described having a plurality of slant wells drilled from the surface to cooperate with a central vertical well within an oil bearing formation. With this design, steam may be injected into the oil bearing formation either from the central vertical well or from the plurality of slant wells.

It is an object of the present invention to provide an improved system for recovering normally immobile hydrocarbon oil from a subsurface tar sand formation by steam injection.

SUMMARY OF THE INVENTION

This invention in its broadest aspect relates to a thermal method for recovering normally immobile hydrocarbon oil from a subsurface tar sand deposit comprising: (a) establishing at least one substantially vertical production bore hole extending from the surface of the earth to at least the bottom of said subsurface formation; (b) providing a plurality of bore holes extending downwardly from the surface of the earth through the tar sand formation to substantially the bottom thereof and then substantially horizontally at or near the bottom of the tar sand formation and converging radially inward to each said bore hole, each said radial bore hole containing a perforated or slotted tube; (c) continuously injecting steam downwardly through said perforated or slotted tubes whereby the steam discharges through the perforations or slots and into the tar sand formation to reduce the viscosity of the normally immobile oil, with a substantial proportion of the steam being injected into the formation via the portion of each tube extending downwardly through the tar sand formation whereby the steam reduces the viscosity of the normally immobile oil over an area extending substantially between the perforated tube and the top of the tar sand formation with this viscosity reducing area expanding radially and moving axially inwardly toward the vertical production bore hole thereby creating an expanding generally conical-shaped production chamber; and (d) draining the less viscous oil and steam condensate thus obtained downwardly by gravity to the bottom of the production chamber and then through the horizontal tubes into the bottom of the vertical production bore hole for collection.

An important feature of this invention is that the steam is injected into the radially converging perforated or slotted bore holes from the surface. In this manner, the injected steam is able to contact the entire vertical section of the tar sand deposit during the initial stages of steam injection, and the maximum steam pressure is at the greatest distance away from the vertical production bore hole. Also, each radially converging bore hole is continuous from the surface to the vertical production bore hole and is simultaneously used for both steam injection and oil production.

This provides important advantages. Firstly, because the greatest heat and pressure from the steam is provided at the greatest distance from the vertical production bore hole and this heat and pressure gradually decrease along the length of each converging radial tube, the result is that oil is removed from the tar sand formation in such a manner that the greatest amount is removed nearest the steam injection end (the furthest distance away from the vertical production bore hole) with decreasing amounts being removed inward along the length of each converging radial tube. As a result, the production areas within the tar sand formation develop a generally conical shape which conforms to the shape of the tar sand formations between the radial tubes thereby maximizing the amount of oil that can be extracted from a tar sand formation by means of a central bore hole with laterally converging radial tubes.

It is also advantageous according to this invention to have a major proportion of the perforated or slotted tubes within the tar sand formation travel horizontally along the bottom of the formation. Thus they sit immediately above an impervious underlayer. This provides a greatly improved extraction efficiency. The injected steam tends to rise within the formation and the use of tubes arranged in both a radial and horizontal configuration means that the maximum possible oil production is achieved within a production area.

The generally conical expanding production zone extends down to the horizontal perforated or slotted pipe and becomes a steam chamber. Thus, the oil of reduced viscosity that is being released from the tar sand formation flows by gravity downwardly through this production zone or steam chamber and into the horizontal perforated or slotted pipe. Because of the higher steam pressure at the outer ends of the perforated tubes, this pressure gradient assists gravity flow in driving the extracted oil within the perforated tubes to the central vertical production bore hole for recovery. A plurality of these central vertical production bore holes with inwardly converging radial tubes may be arranged as an array in a tar sand formation, and by operating such installations in a simultaneous manner, an entire tar sand field can be drained in a systematic manner.

The central vertical production bore hole preferably extends a distance down into an impervious formation underlying the tar sand formation to thereby form a sump for collecting the less viscous (flowable) oil. This flowable oil is pumped from the sump to the surface by conventional oil field pumping systems.

It is also preferred to provide a casing for the vertical production bore hole at least within the tar sand formation. This prevents early steam breakthrough into the central bore hole and maintains the integrity of the central vertical production bore hole.

The process of this invention also makes it possible to control the heat input to the tar sand formation such that steam is not wasted. This is achieved by monitoring the temperature of the hot oil and steam condensate emerging from each converging radial tube. Based on this temperature, it is then possible to adjust the steam input to each radial tube such that only sensible heat is produced in the form of the hot oil and steam condensate, along with a minimal amount of latent steam.

The process of this invention can be used in situations where the thickness of the overburden and tar sand formation vary quite widely. It is of particular value for situations where the overburden is too thick for the use of surface mining. As a general rule, surface mining is considered uneconomic if more overburden must be removed than there is tar sand resource.

A single central bore hole can recover oil from a quite large area, with the individual perforated or slotted tubes extending radially outwardly several hundred meters or more.

BRIEF DESCRIPTION OF THE DRAWINGS

These and other features and advantages of the present invention will become apparent from the following detailed description, wherein reference is made to the figures in the accompanying drawings in which:

Referring now to FIG. 1, there may be seen a simplified pictorial representation of one type of system embodying the concepts of the present invention for recovering heavy oil and the like from a subsurface formation, e.g. tar sand, and depicting a substantially vertical central production bore hole 13 drilled from the surface of the earth 10 through overburden 11 and into a subsurface tar sand formation 12. The bore hole 13 is drilled completely through the formation 12 to the bottom face 14 thereof, this being the top face of an impermeable geological formation 17, e.g. limestone. Converging radially inward to the bore hole 13 are a plurality of perforated or slotted injection/production tubes 16 which extend down from the surface 10.

Figure 2:
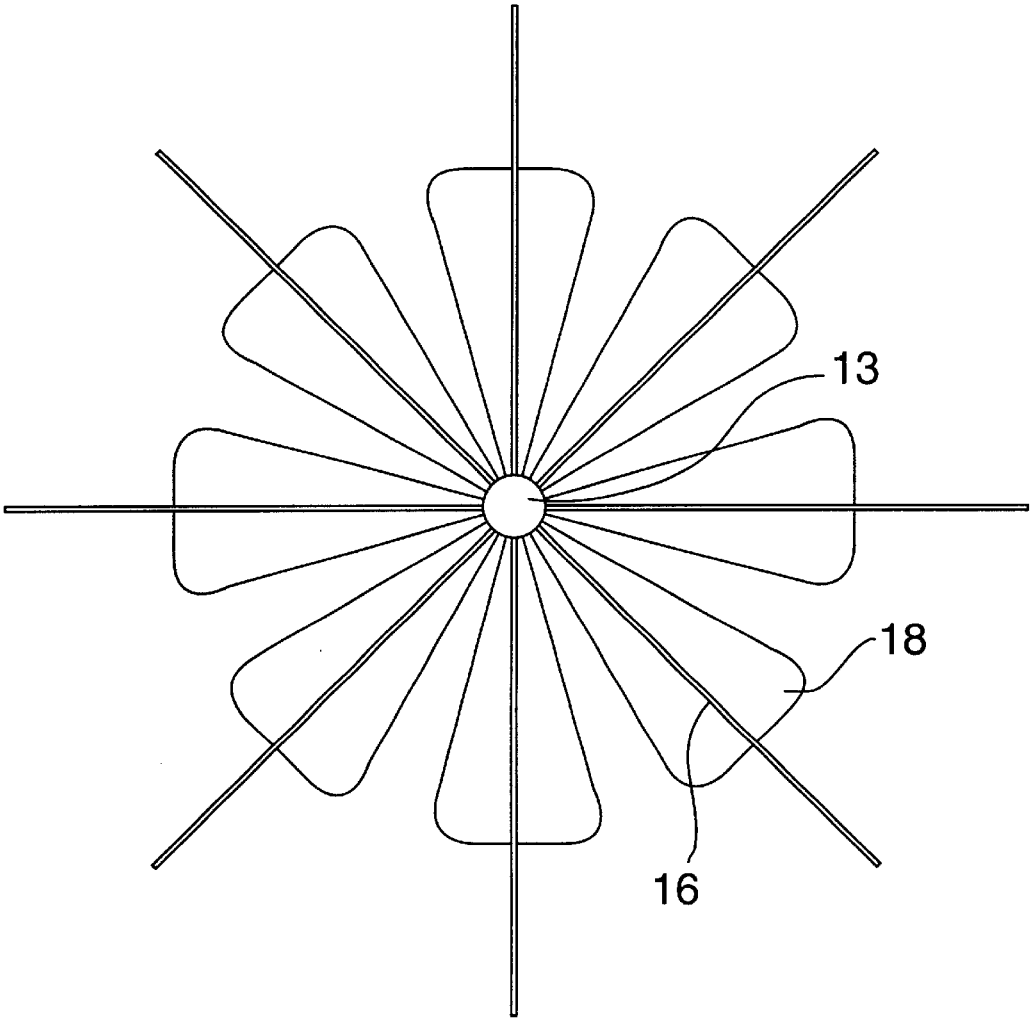
FIG. 2 is a simplified functional representation of a general plan view of an installation according to FIG. 1.
Figure 2A:
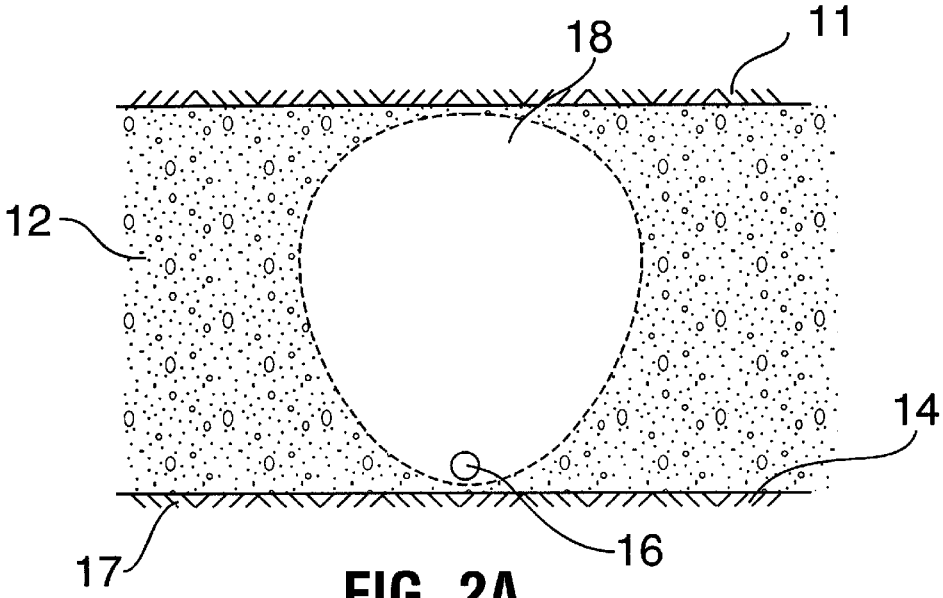
FIG. 2A is a sectional view of a production chamber shown in FIG. 2.

The perforated or slotted injection/production tubes 16 extend down from the surface 10 usually at an incline to the vertical, and then extend horizontally a substantial distance along the bottom of the tar sand formation 12. For deeper formations, it is also possible to have the tubes 16 start vertically. These horizontal portions are located close to the bottom face 14 of the tar sand formation 12. Steam is fed down into the perforated or slotted injection/production tubes 16 from the surface and discharged through the perforations or slots into the tar sand formation 12. The temperature, pressure and quality of the injected steam decreases as it progresses along the length of the perforated tube 16 within the formation so that its maximum effectiveness is at the end furthest from the vertical central bore hole 13, with this effectiveness decreasing along the length of the tube. As a consequence, a pattern of oil excavation from the formation is established which matches this variation in the condition of the steam injection. The result is an excavation pattern shown in FIG. 2 and FIG. 2A where the excavated areas assume a generally wedge or conical shape. This provides the maximum amount of oil recovery from an arrangement of a vertical bore hole and radially converging injection/production tubes.

Figure 1:
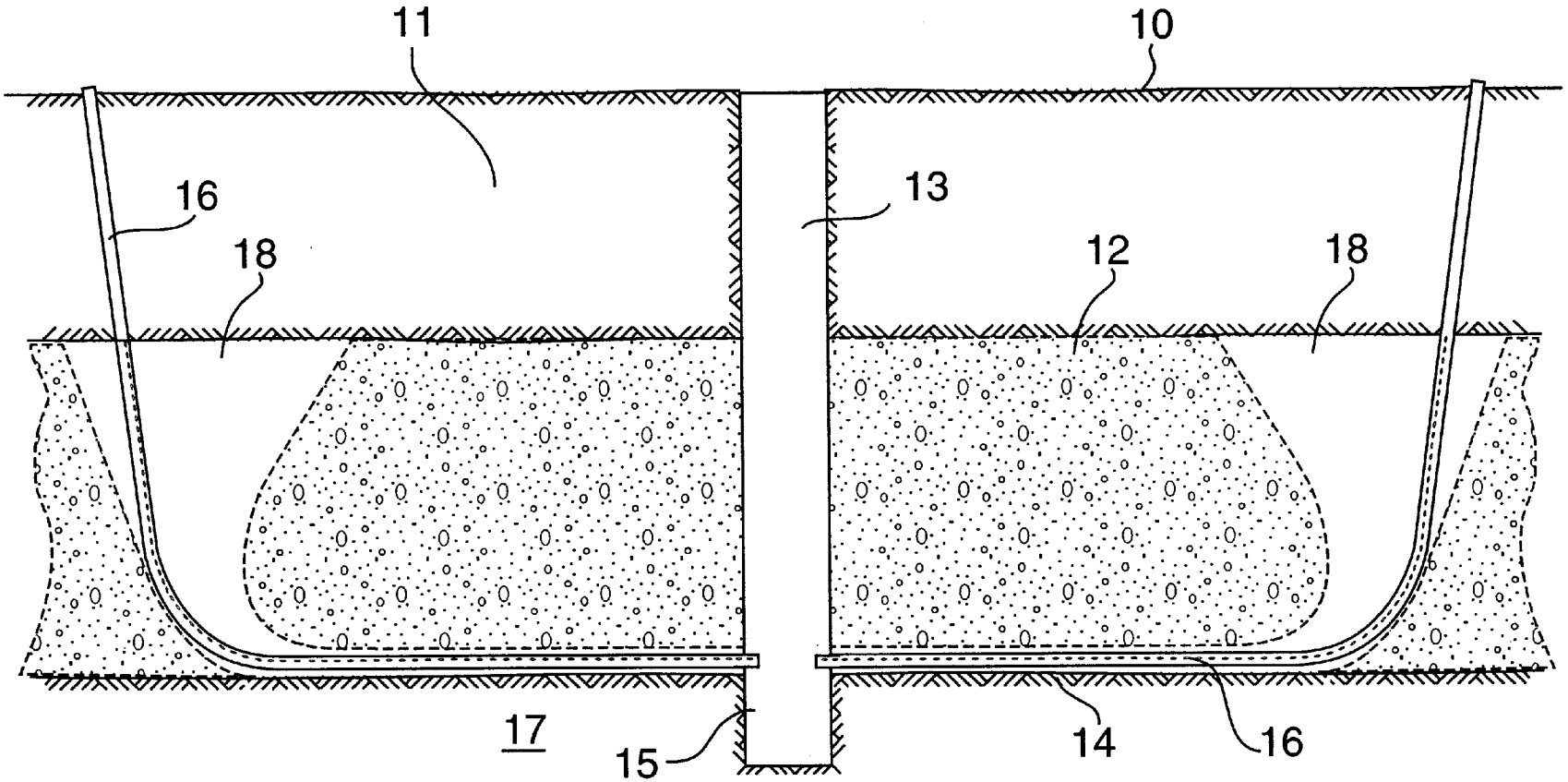
FIG. 1 is a simplified pictorial representation partly in cross section of a portion of an exemplary installation for recovering oil from a subsurface earth formation according to the concepts of the present invention.
Figure 1A:
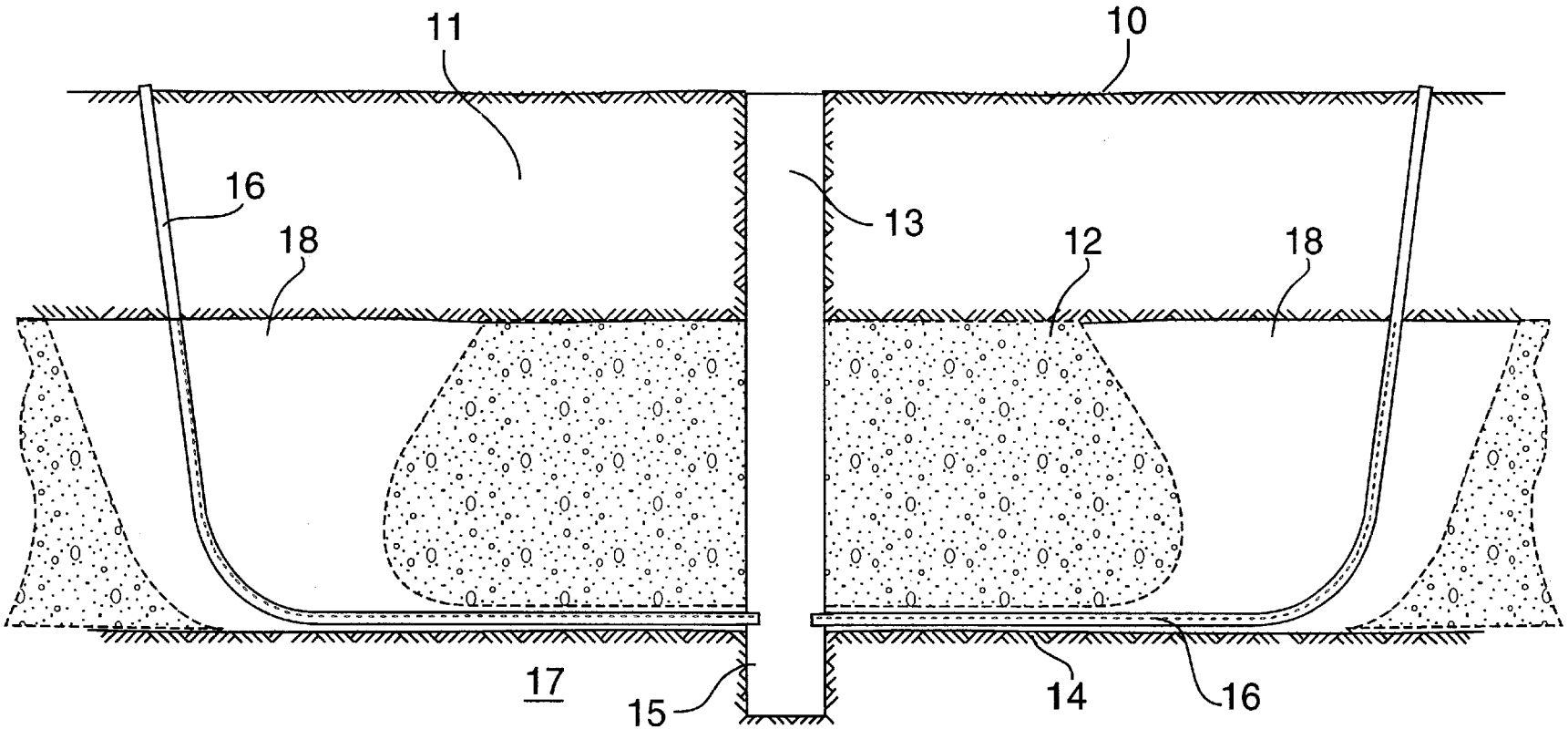
FIG. 1A is a modification of the view of FIG. 1.

From these excavated areas 18, the oil of reduced viscosity drains into perforated tube 16 and flows to bore hole sump 15 for recovery. Because the steam is at its greatest pressure at the ends furthest from the vertical bore hole 13, it has the effect of pushing the oil of reduced viscosity from this area toward the vertical production bore hole 13. FIG. 1 shows excavation 18 at an early stage, while FIG. 1A shows the growth of these excavations over time.

Figure 3:
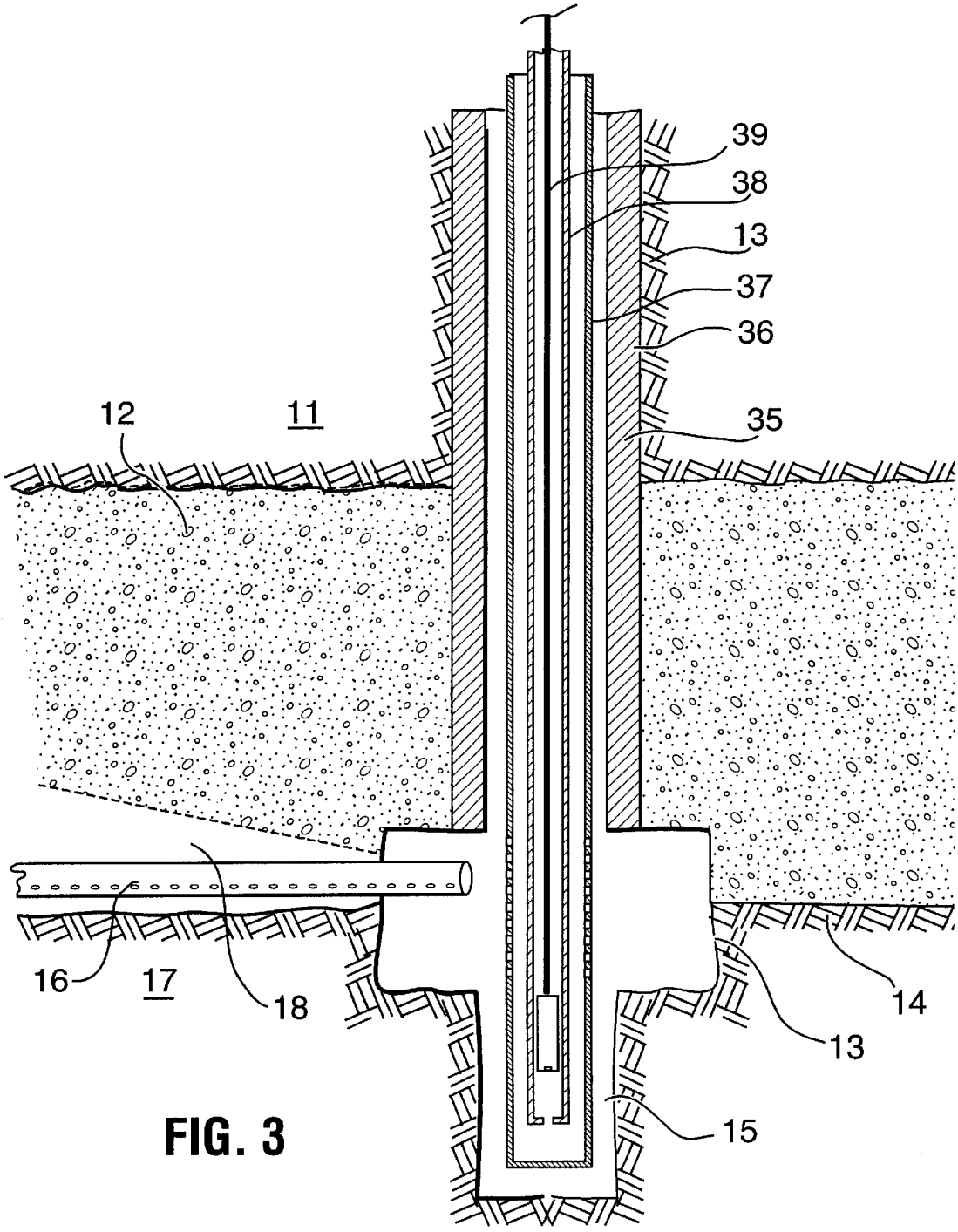
FIG. 3 is a sectional view showing details of a central bore hole.

In order to effectively create these excavations according to the invention, it is necessary to prevent any steam breakthrough into the central bore hole 13. Accordingly, a casing 36 may be provided as shown in FIG. 3. This casing extends down through the tar sand formation 12 substantially to the bottom thereof.

The central bore hole is described in greater detail in FIG. 3, showing casing 36 cemented in place by cement 35.

Within casing 36 are positioned a production liner 37, which carries production tubing 38 and sucker rod 39.

The lower end of bore hole 13 preferably extends down into the impervious formation 17 to form a sump 15. It is also preferable to form a region of enlarged diameter or milled section 13*a* in a lower portion of bore hole 13, with the injection/production tubes 16 connecting to this enlarged portion 13*a*. The production liner 37 may also be perforated in this region.

Figure 4:
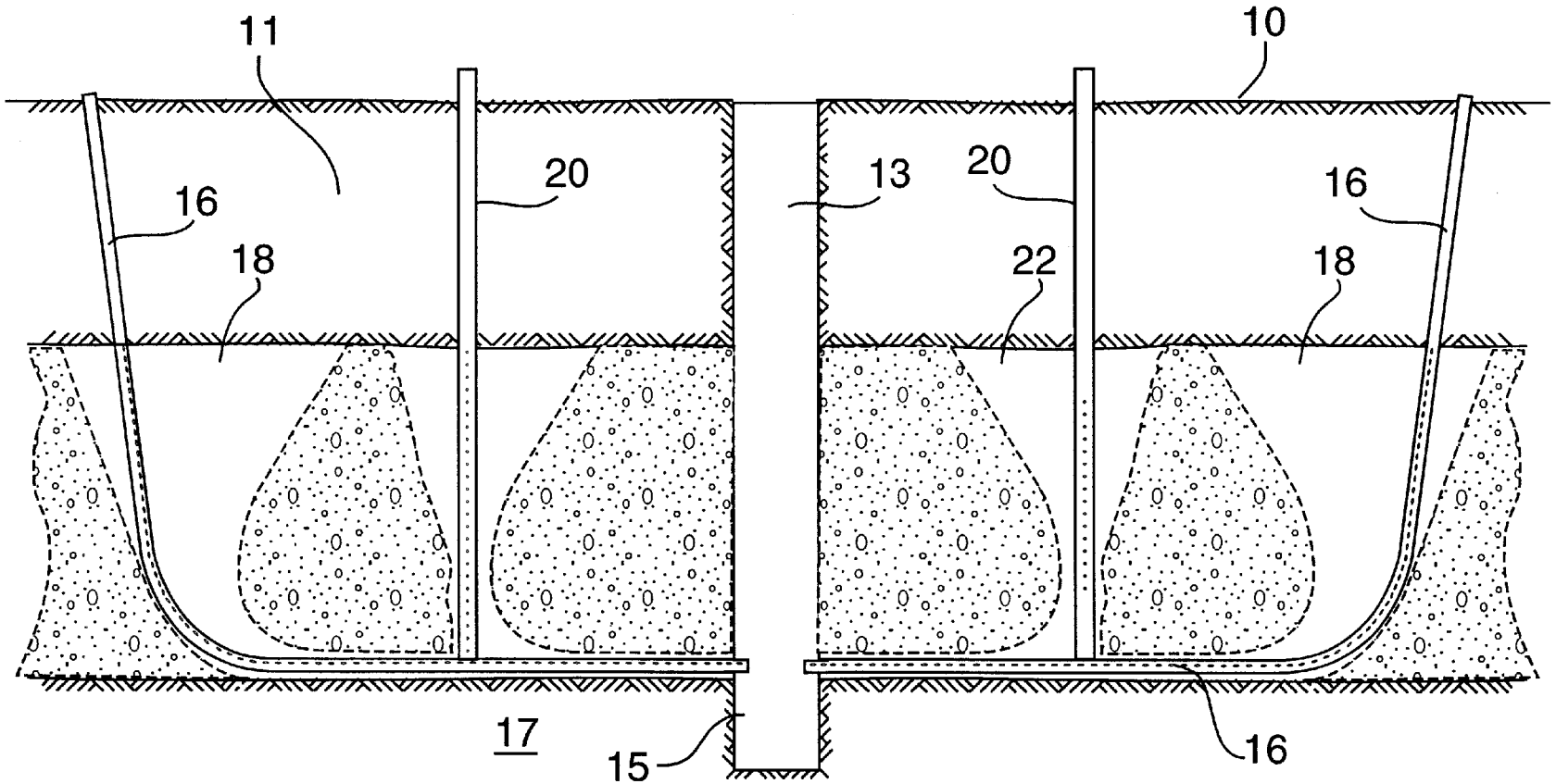
FIG. 4 is a similar view as FIG. 1 with additional injection/production wells.
Figure 5:
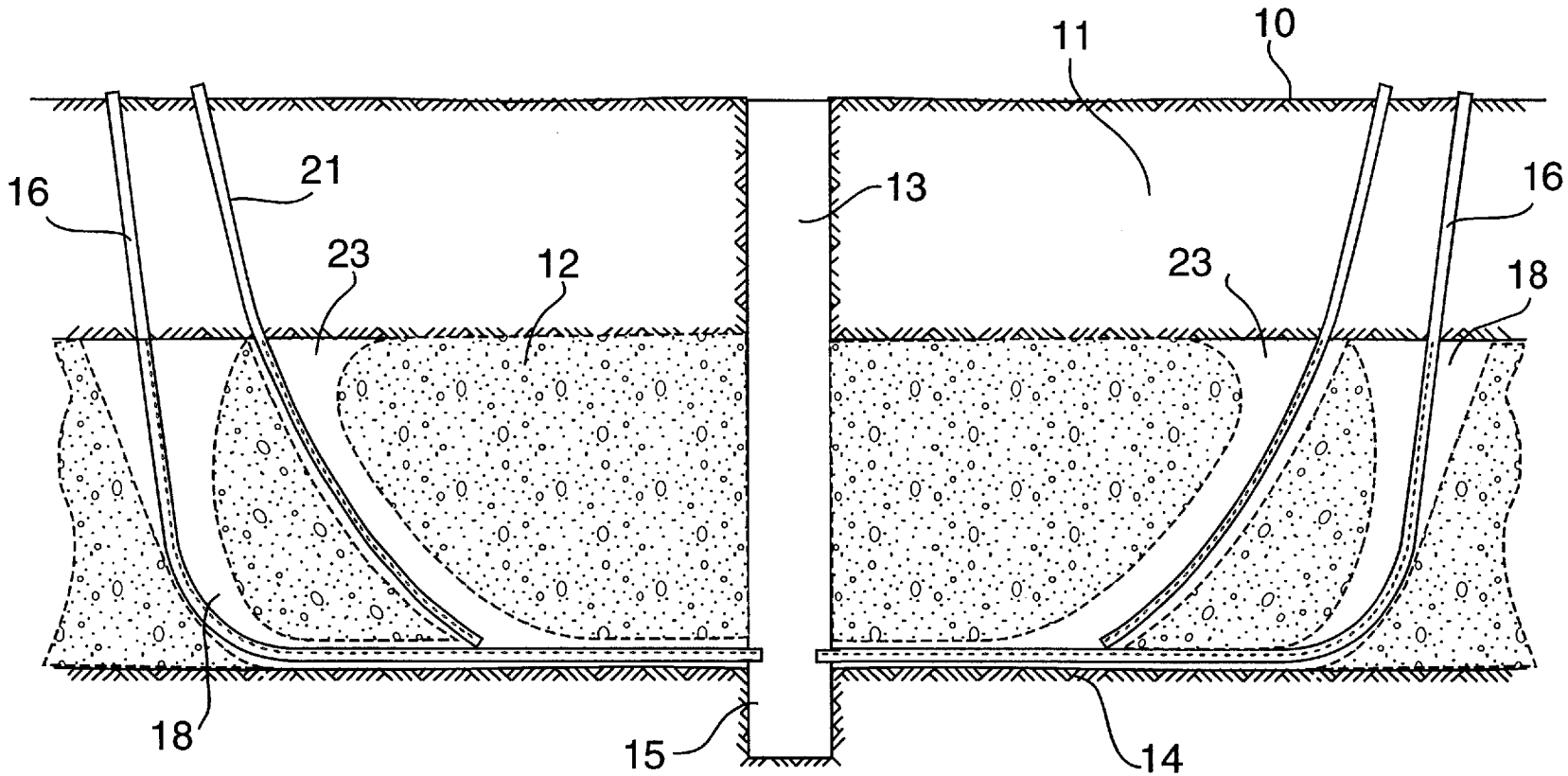
FIG. 5 is a similar view of FIG. 1 with a further arrangement of additional injection/production wells.

FIGS. 4 and 5 show additional perforated or slotted injection/production tubes 20, 21 extending from the surface 10 down to join main radial injection/production tubes 16. These create additional production areas 22, 23 which feed additional viscosity reduced (flowable) oil into the radial tubes 16.

Figure 6:
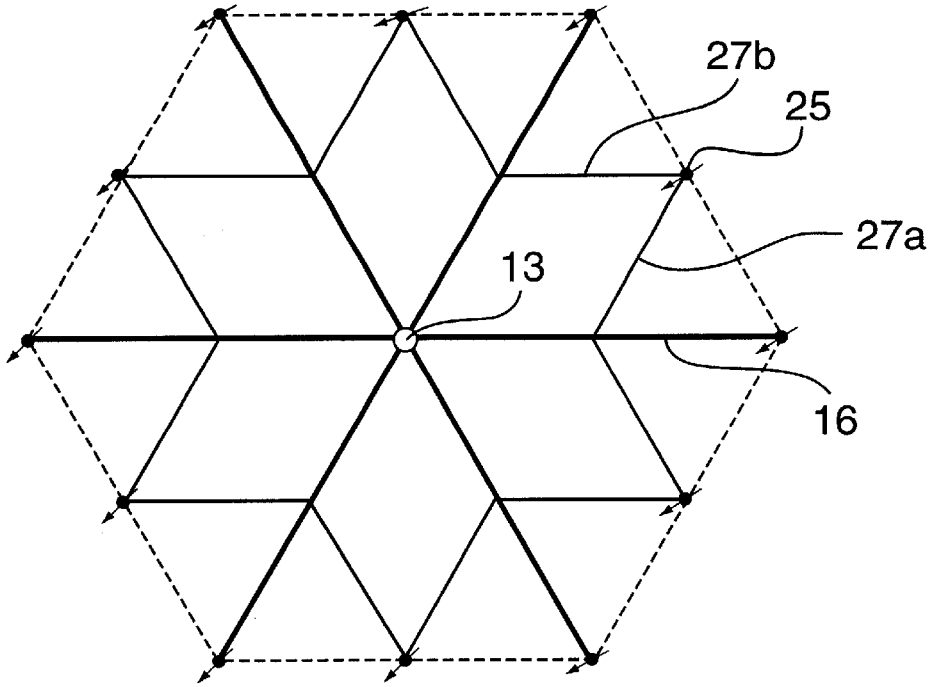
FIG. 6 is a plan view as FIG. 2 showing auxiliary injection/production tubes between main radial tubes.
Figure 7:
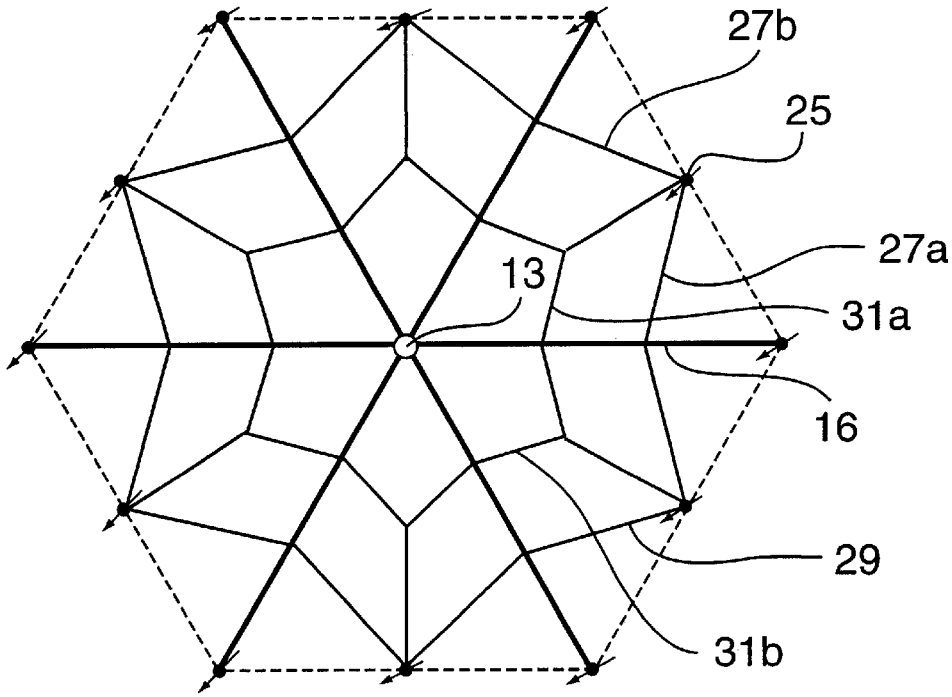
FIG. 7 is a plan view as FIG. 2 showing a further arrangement of auxiliary injection/production tubes between main radial tubes.
Figure 8:
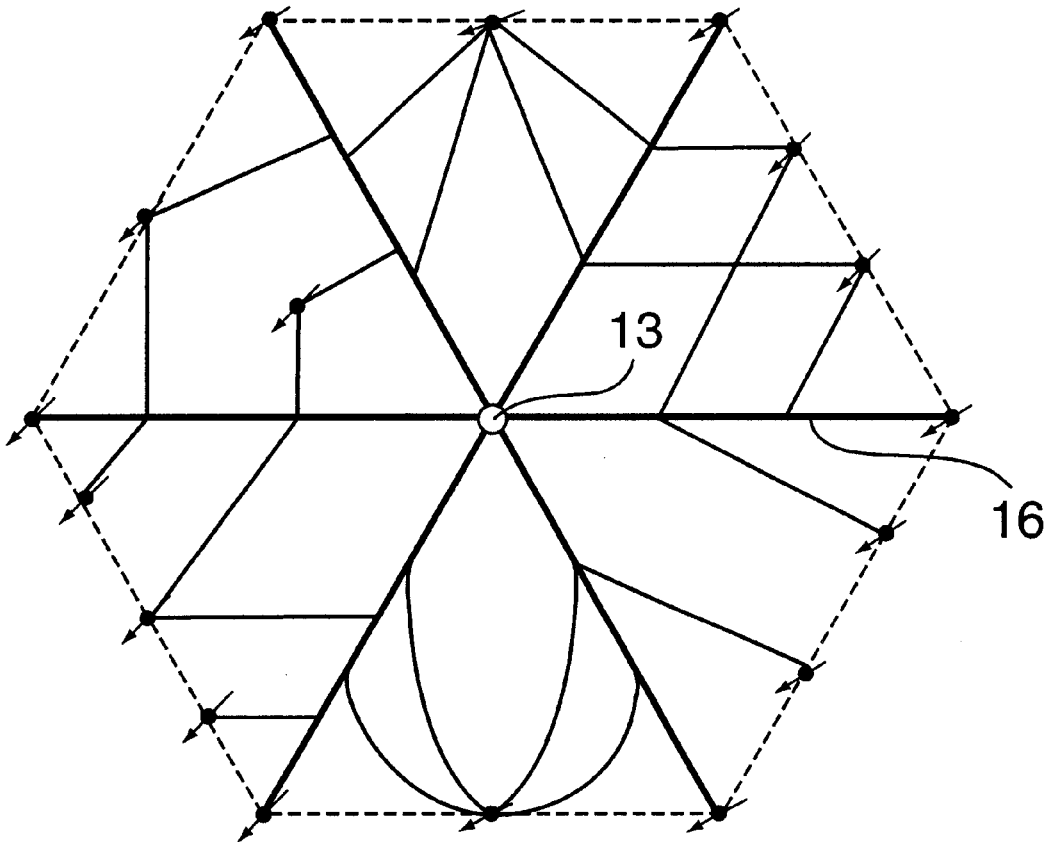
FIG. 8 is a plan view as FIG. 2 showing a still further arrangement of auxiliary injection/production tubes between main radial tubes.

FIGS. 6, 7 and 8 show further arrangements of additional perforated or slotted injection/production tubes extending from the surface 10 down to substantially join main radial tubes 16. Thus, in FIG. 6, in addition to the main radial perforated tubes 16, there are a series of additional perforated tubes extending down from the surface from locations 25. A pair of perforated tubes 27*a* and 27*b* extend down from each location 25, with lower regions of perforated tubes 27*a*, 27*b* extending laterally within the tar sand formation and terminating proximate adjacent main radial tubes 16.

FIG. 7 represents a further development of FIG. 6 with a third tube 29 extending down from the surface at each location 25. These tubes include further lateral branches 31*a*, 31*b* terminating proximate the adjacent main radial tubes 16.

FIG. 8 shows different combinations of auxiliary perforated tubes within each sector between main radial tubes 16. In each arrangement the perforated tubes extend down from the surface and then laterally within the tar sand formation such that the bottom end of each auxiliary perforated tube terminates approximate a mid-region of each main radial tube extending laterally within the tar sand formation.

The arrangements of FIGS. 6, 7 and 8 all provide additional networks of production zones in which the auxiliary perforated tubes extending down from the surface feed steam into the formation. This lowers the viscosity of normally immobile hydrocarbon oil adjacent each auxiliary perforated tubes so that oil of reduced viscosity is produced which then flows along within each auxiliary perforated tube and then into the adjacent main radial tubes and eventually into the central production bore hole 13.

It will be understood that the arrangements shown in the above drawings are rather idealized and that there may be many variations in the configurations of bore holes and radially converging perforated tubes depending on the nature and structure of the formations encountered.

What is claimed is:

1. A thermal method for recovering normally immobile hydrocarbon oil from a subsurface formation containing a tar sand deposit comprising:

(a) establishing at least one substantially vertical production bore hole extending from the surface of the earth to at least the bottom of said subsurface formation;

(b) providing a plurality of auxiliary bore holes extending downwardly from the surface of the earth through the tar sand formation to substantially the bottom thereof and then substantially horizontally near the bottom of the tar sand formation and converging radially inward to the at least one production bore hole, each said radial auxiliary bore hole containing a perforated or slotted tube with the entire portion of the tube passing through the tar sand formation being perforated or slotted;

(c) continuously injecting steam downwardly through said perforated or slotted tubes whereby the steam discharges through the perforations or slots and into the tar sand formation to reduce the viscosity of the normally immobile oil, the injected steam having a temperature and pressure which both decrease as the steam travels downwardly through the tubes whereby a substantial proportion of the steam being injected into the formation via the portion of each tube extending downwardly through the tar sand formation reduces the viscosity of the normally immobile oil over an area extending substantially between the perforated tube and the top of the tar sand formation with this viscosity reducing area expanding radially and moving axially inwardly toward the at least one vertical production bore hole thereby creating an expanding generally conical-shaped production chamber in response to the decreasing steam temperature and pressure; and (d) simultaneously continuously draining the less viscous oil and steam condensate thus obtained downwardly by gravity to the bottom of the production chamber 7 then into the horizontal tubes by way of said perforations or slots and thence into the bottom of the at least one vertical production bore hole for collection.

2. A method according to claim 1 wherein the production bore hole extends down into an impervious formation underlying the tar sand formation.

3. A method according to claim 1 wherein a casing is inserted into the production bore hole and extends substantially to the bottom of the tar sand formation.

4. A method according to claim 1 wherein the production chamber comprises an expanding seam chamber.

5. A method according to claim 1 wherein the temperature of the less viscous oil and steam condensate emerging from each converging radial tube is monitored and the steam input to each radial tube is adjusted accordingly such that only sensible heat is produced in the form of the less viscous oil and steam condensate.

6. A method according to claim 1 wherein the tar sand formation is buried at a depth at least equal to the thickness of the tar sand formation.

7. A method according to claim 1 wherein the portion of each perforated or slotted tube passing downwardly through the tar sand formation is inclined from the vertical.

8. A method according to claim 7 wherein additional bore holes containing perforated or slotted tubes extend downwardly from the surface of the earth through said tar sand formation to fluidly connect with said horizontally extending perforated or slotted tubes.

9. A method according to claim 8 wherein the additional perforated or slotted tubes pass through the tar sand formation in a substantially vertical direction.

10. A method according to claim 8 wherein the additional perforated or slotted tubes pass through the tar sand formation in a direction inclined from the vertical.

* * * * *